US005755171A

United States Patent [19]

Tsukahara

[11] Patent Number: 5,755,171

[45] Date of Patent: May 26, 1998

[54] CONTROL APPARATUS AND METHOD FOR SEWING MACHINE

[75] Inventor: Hisaaki Tsukahara, Tokyo, Japan

[73] Assignee: Mitsubishi Denki Kabushiki Kaisha, Tokyo, Japan

[21] Appl. No.: 600,156

[22] Filed: Feb. 12, 1996

[30] Foreign Application Priority Data

Feb. 15, 1995 [JP] Japan ..... 7-026980
Aug. 24, 1995 [JP] Japan ..... 7-215999

[51] Int. Cl.[6] ..... D05B 19/12; D05B 21/00

[52] U.S. Cl. ..... 112/470.06; 112/475.05

[58] Field of Search ..... 112/470.06, 102.5, 112/103, 311, 470.28, 475.04, 475.05, 475.07, 475.19

[56] References Cited

U.S. PATENT DOCUMENTS 3,970,016 7/1976 Yanikoski ..... 112/102.5
5,372,078 12/1994 Hoshina et al. ..... 112/102.5 X

FOREIGN PATENT DOCUMENTS 32 13 277 C2 12/1985 Germany .
30 22 904 C3 10/1989 Germany .
34 90 617 C2 12/1990 Germany .
34 43 785 C2 11/1992 Germany .
62-112587 5/1987 Japan ..... D05B 21/00

*Primary Examiner*—Peter Nerbun
*Attorney, Agent, or Firm*—Sughrue, Mion, Zinn, Macpeak & Seas, PLLC

[57] ABSTRACT

A control apparatus for a sewing machine in which a microcomputer in the control unit of the sewing machine is provided with a sequence control function, and an on-signal for setting and removing a workpiece is incorporated into the sewing data, whereby no PC exclusively used for sequence control is required. A control apparatus of the invention includes an actuator for setting a workpiece on the sewing machine or removing it from the sewing machine, drive means for driving the actuator on and off, a storage element for storing on-data in the sewing data by which a workpiece is automatically sewn, the on-data serving as an on-signal to set the workpiece on the sewing machine or remove it from the sewing machine, detection means for generating a completion signal of the setting or removing of the workpiece, command means for generating an off-signal in the drive means in accordance with the detection of the completion signal by the detection means, start means for starting to set the workpiece on the sewing machine or remove it from the sewing machine by operating the actuator when the drive means is turned on in accordance with the on-signal, and stop means for stopping motion of the actuator by turning off the drive means in accordance with the off-signal.

4 Claims, 15 Drawing Sheets

FIG. 2

| SEWING DATA | | | | MOTION |
|---|---|---|---|---|
| CONTROL CODE (4n) | ARGUMENT 1 (4n + 1) | ARGUMENT 2 (4n + 2) | ARGUMENT 3 (4n + 3) | |
| 00000100 (MODULE START) | 00000001 (MODULE 1) | 00000000 (NOT USED) | 00000000 (NOT USED) | CLOTH 90 IS SET. |
| 00000011 (NO-LOAD FEEDING) | (SPEED OF NO-LOAD FEEDING) | (AMOUNT OF MOVEMENT IN X-DIRECTION) | (AMOUNT OF MOVEMENT IN Y-DIRECTION) | NO-LOAD FEEDING FROM HOME POSITION TO POINT "a". |
| IN CASE OF SHORTAGE OF AN AMOUNT OF NO-LOAD FEEDING, NO-LOAD FEEDING DATA IS ADDED. | | | | |
| 00000001 (SEWING) | (SEWING SPEED) | (AMOUNT OF MOVEMENT IN X-DIRECTION) | (AMOUNT OF MOVEMENT IN Y-DIRECTION) | SEW 3 STITCHES FROM POINT "a" TO POINT "b". |
| 00000001 (SEWING) | (SEWING SPEED) | (AMOUNT OF MOVEMENT IN X-DIRECTION) | (AMOUNT OF MOVEMENT IN Y-DIRECTION) | |
| 00000001 (SEWING) | (SEWING SPEED) | (AMOUNT OF MOVEMENT IN X-DIRECTION) | (AMOUNT OF MOVEMENT IN Y-DIRECTION) | |
| 00000000 (STOP) | (NOT USED) | (NOT USED) | (NOT USED) | TEMPORARILY STOPPED BEFORE THE POINT "b". |
| 00000100 (MODULE START) | (MODULE 2) | (NOT USED) | (NOT USED) | CLOTH 91 IS SET. |
| 00000001 (SEWING) | (SEWING SPEED) | (AMOUNT OF MOVEMENT IN X-DIRECTION) | (AMOUNT OF MOVEMENT IN Y-DIRECTION) | SEW 13 STITCHES FROM POINT " b" TO POINT "d". |
| ARRANGE ABOVE DATA 12 TIMES. | | | | |
| 00000010 (CUT THREAD) | (NOT USED) | (NOT USED) | (NOT USED) | THREAD CUTTING |
| 00000100 (MODULE START) | 00000011 (MODULE 3) | (NOT USED) | (NOT USED) | REMOVE PLACES OF THE CLOTH 90, 91. |
| 11111111 (END) | (NOT USED) | (NOT USED) | (NOT USED) | RETURN TO HOME POSITION AND END. |

FIG. 6

PARAMETER BLOCK NO. 1

| PARAMETER NUMBER | MEANING | SETTING VALUE |
|---|---|---|
| 00000000 | CLOTH THICKNESS | 0.5mm |
| 00000001 | SIZE CHANGING RATIO | 100% |
| 00000010 | FABRIC PRESSER WEIGHT | 5Kg |
| 00000011 | RESTRICTION OF MOTOR TORQUE | 0.18N/m |

PARAMETER BLOCK NO. 2

| PARAMETER NUMBER | MEANING | SETTING VALUE |
|---|---|---|
| 00000000 | CLOTH THICKNESS | 0.7mm |
| 00000001 | SIZE CHANGING RATIO | 50% |
| 00000010 | FABRIC PRESSER WEIGHT | 3Kg |
| 00000011 | RESTRICTION OF MOTOR TORQUE | 0.2N/m |

FIG. 7

| SEWING DATA | | | | MOTION |
|---|---|---|---|---|
| CONTROL CODE (4n) | ARGUMENT 1 (4n + 1) | ARGUMENT 2 (4n + 2) | ARGUMENT 3 (4n + 3) | |
| 00000011 (NO-LOAD FEEDING) | (SPEED OF NO-LOAD FEEDING) | (AMOUNT OF MOVEMENT IN X-DIRECTION) | (AMOUNT OF MOVEMEN IN Y-DIRECTION) | NO-LOAD FEEDING FROM HOME POSITION TO POINT "a". |
| IN THE CASE OF SHORTAGE OF AN AMOUNT OF NO-LOAD FEEDING, NO-LOAD FEEDING DATA IS ADDED. | | | | |
| 00000110 (CHANGE IN THE PARAMETER) | 00000000 (SET CLOTH THICKNESS) | (CLOTH THICKNESS OF POINT "a") | | SET CLOTH THICKNESS FROM POINT "a" TO POINT "b". |
| 00000001 (SEWING) | (SEWING SPEED) | (AMOUNT OF MOVEMENT IN X-DIRECTION) | (AMOUNT OF MOVEMENT IN Y-DIRECTION) | SEW 3 STITCHES FROM POINT "c" TO POINT "b". |
| ARRANGE ABOVE DATA 2 TIMES. | | | | |
| 00000110 (CHANG IN THE PARAMETER) | 00000000 (SET CLOTH THICKNESS) | (CLOTH THICKNESS OF POINT "b") | | CLOTH THICKNESS IS SET FROM POINT "b" TO POINT "e". |
| 00000001 (SEWING) | (SEWING SPEED) | (AMOUNT OF MOVEMENT IN X-DIRECTION) | (AMOUNT OF MOVEMENT IN Y-DIRECTION) | SEW 2 STITCHES FROM POINT "b" TO POINT "e". |
| 00000001 (SEWING) | (SEWING SPEED) | (AMOUNT OF MOVEMENT IN X-DIRECTION) | (AMOUNT OF MOVEMENT IN Y-DIRECTION) | |
| 00000110 (CHANGE IN THE PARAMETER) | 00000000 (SET CLOTH THICKNESS) | (CLOTH THICKNESS OF POINT "e") | | SET CLOTH THICKNESS FROM POINT "e" TO POINT "f". |
| 00000001 (SEWING) | (SEWING SPEED) | (AMOUNT OF MOVEMENT IN X-DIRECTION) | (AMOUNT OF MOVEMENT IN Y-DIRECTION) | SEW 11 STITCHES FROM POINT "e" TO POINT "c". |
| ARRANGE ABOVE DATA 10 TIMES. | | | | |
| 00000110 (CHANGE IN THE PARAMETER) | 00000000 (SET CLOTH THICKNESS) | (CLOTH THICKNESS OF POINT "c") | | SET CLOTH THICKNESS FROM POINT "c" TO POINT "d". |
| 00000001 (SEWING) | (SEWING SPEED) | (AMOUNT OF MOVEMENT IN X-DIRECTION) | (AMOUNT OF MOVEMENT IN Y-DIRECTION) | SEW 2 STITCHES FROM POINT "c" TO POINT "d". |
| ARRANGE ABOVE DATA 2 TIMES. | | | | |
| 00000010 (CUT THREAD) | (NOT USED) | (NOT USED) | (NOT USED) | CUT THREAD |
| 11111111 (END) | (NOT USED) | (NOT USED) | (NOT USED) | RETURN TO HOME POSITION AND END |

FIG. 12

| SEWING DATA | | | | MOTION |
|---|---|---|---|---|
| CONTROL CODE (4n) | ARGUMENT 1 (4n + 1) | ARGUMENT 2 (4n + 2) | ARGUMENT 3 (4n + 3) | |
| 00000011 (NO-LOAD FEEDING) | (SPEED OF NO-LOAD FEEDING) | (AMOUNT OF MOVEMENT IN X-DIRECTION) | (AMOUNT OF MOVEMENT IN Y-DIRECTION) | NO-LOAD FEEDING FROM HOME POSITION TO POINT "a". |
| IN CASE OF SHORTAGE OF AN AMOUNT OF NO-LOAD FEEDING, NO-LOAD FEEDING DATA IS ADDED. | | | | |
| 00000001 (SEWING) | (SEWING SPEED) | (AMOUNT OF MOVEMENT IN X-DIRECTION) | (AMOUNT OF MOVEMENT IN Y-DIRECTION) | SEW 3 STITCHES FROM POINT "a" TO POINT "b". |
| 00000001 (SEWING) | (SEWING SPEED) | (AMOUNT OF MOVEMENT IN X-DIRECTION) | (AMOUNT OF MOVEMENT IN Y-DIRECTION) | |
| 00000001 (SEWING) | (SEWING SPEED) | (AMOUNT OF MOVEMENT IN X-DIRECTION) | (AMOUNT OF MOVEMENT IN Y-DIRECTION) | |
| 00000000 (STOP) | (NOT USED) | (NOT USED) | (NOT USED) | TEMPORARILY STOPPED BEFORE POINT "b". |
| 00000001 (SEWING) | (SEWING SPEED) | (AMOUNT OF MOVEMENT IN X-DIRECTION) | (AMOUNT OF MOVEMENT IN Y-DIRECTION) | SEW 13 STITCHES FROM POINT " b" TO POINT "d". |
| ARRANGE ABOVE DATA 12 TIMES. | | | | |
| 00000010 (CUT THREAD) | (NOT USED) | (NOT USED) | (NOT USED) | THREAD CUTTING |
| 11111111 (END) | (NOT USED) | (NOT USED) | (NOT USED) | RETURNED TO HOME POSITION AND END. |

CONTROL APPARATUS AND METHOD FOR SEWING MACHINE

BACKGROUND OF THE INVENTION

The present invention relates to a control apparatus for a sewing machine which moves a fabric pressing device gripping a workpiece to form stitches of a predetermined shape, and also relates a control method for such a sewing machine.

Referring to FIG. 10, the mechanism section of a conventional sewing machine will be described. In FIG. 10, reference numeral 11 is a sewing machine mechanism section which includes a mechanism for forming stitches in a workpiece. This sewing machine mechanism section 11 is mounted on a table 12 and is connected with a needle bar 13 for stitching the workpiece. A needle position detector 13*a* detects the position of the needle bar 13. A fabric presser 17 grips a workpiece between an upper pressure plate 15 and a lower pressure plate 16. The fabric presser 17 is located above a bed slide 18 and is provided with an X-Y table 19 which moves the workpiece on a plane. There are provided home position detectors 20*a*, 20*b*, namely, home position detection means for detecting the mechanical home position of the X-Y table 19.

On the upper surface of a control box 10, there is provided an operating panel 22 on which various switches for setting the sewing machine operation are arranged. The operating panel 22 includes a liquid-crystal display (LCD) 24 for displaying stitching conditions, and a group of switches 27. There is further provided a foot pedal 31 in the lower portion of the control box 10. The foot pedal 31 is provided with a start switch 32, used to issue a stitching start command, and a fabric presser switch 33, which keeps cloth gripped under pressure by the fabric presser 17.

Referring to FIG. 11, the control circuit of the conventional sewing machine will be described as follows. In FIG. 11, reference numeral 2 is a microcomputer. This microcomputer 2 is connected to a read-only-memory ROM 52 in which a control program and other programs are stored, a random access memory RAM 53 in which the sewing data for automatically sewing a workpiece shown in FIG. 12 is stored, a latch circuit 55 for latching the addresses of the ROM 52 and RAM 53, a selection circuit 56 for generating a signal to select a peripheral element, an interface (I/F) 22*a* to which the operating panel 22 is connected, a needle position detector 13*a* connected via an I/F 13*c*, a foot pedal 31 connected via an I/F 31*a*, a servo motor 21 connected via the drive circuit 21*b*, home position detectors 20*a*, 20*b* connected via an I/F 20*c*, pulse motors 19*a*, 19*b* for driving the X-Y table 19 via the drive circuit 19*c*, and a programmable controller (PC) 65, which is a computer exclusively used for sequential control. The PC 65 is connected to an actuator 17*a* for driving the fabric presser 17 via the drive circuit 17*b*.

In this arrangement, the control unit 10 effects control operations so as to sew pieces of cloth 90, 91. The PC 65 generates an on-signal to remove and set pieces of cloth 90, 91. A completion signal for removing and setting the cloth is applied to the drive circuit 17*b* of the actuator 17*a*. The completion of setting or removing of pieces of cloth 90, 91 is detected by a sensor (not shown in the drawing), i.e., a detection means, and this detection signal is received by the PC 65.

After generation of a signal to set the cloth 90 at the sewing machine, the setting signal is turned off in response to the completion signal. After the setting signal of the cloth 90 has been received, the setting signal is turned off in response to the completion signal after the generation of a signal to set the cloth 91 at the sewing machine. Once the setting signal of the cloth 91 has been received, the removing signal is turned off by the completion signal after the generation of the removing signal of the pieces of cloth 90, 91 from the sewing machine. The above sequence of control is carried out by the PC 65. Reference numeral 70 is a reset circuit of the microcomputer 2.

Next, referring to FIG. 13, the operation of the control unit of the above sewing machine will be described below, in which pieces of cloth 90, 91, which are workpieces, are set in the sewing machine so as to be sewn. FIG. 14 is a flow chart indicating how the sewing data shown in FIG. 12 is applied. FIG. 15 is a flow chart relating to the generation of a signal in the case of transfer of the workpiece through each process in FIG. 13.

In this case, the operation is conducted as follows. The X-Y table 19 is located at the home position. The sewing start switch 32 is turned on, so that an operation start signal is applied to the microcomputer 2. When the start signal is detected (step 300), the PC 65 issues a signal to the drive circuit 17*b* for setting the cloth 90 in the sewing machine (step 301), and the actuator 17*a* moves the cloth 90 and sets it in the sewing machine.

If operation start signal is not detected in step 300, the signal detection process is continued.

The microcomputer 2 reads a control code "no-load feeding" in the sewing data stored in RAM 53 (step 200). Then the microcomputer 2 reads an argument and moves the needle 13 from the home position to the point "a" shown in FIG. 13 in accordance with the feeding speed and the amounts of movement in the X and Y directions (referred to as a "no-load feeding condition" hereinafter). Next, the control code is advanced by one step (step 201). Since the control code is "sewing", the argument is read, and while the cloth 90 is sewn through three stitches from point "a" to point "b" as shown in FIG. 13, the PC 65 counts the number of output pulses of the needle position detector 13*a*. When the correct number of output pulses of the needle position detector 13*a* has been counted, a sewing interruption signal is applied to the microcomputer 2 (step 302), so that the sewing operation is stopped.

The PC 65 issues a signal to the drive circuit 17*b* for setting the cloth 91 (step 303), and the actuator 17*a* moves the cloth 91 so that the cloth 91 can be set on the cloth 90. Then, the PC 65 receives a setting completion signal from the sensor, so that the generation of the setting signal is stopped. Next, the control code is advanced by one step (step 201), and then a control word "sewing" of the sewing data is read (step 200), and this argument is read. While the workpiece is sewn by 13 stitches from point "*b*" to point "*d*" in accordance with the sewing condition as shown in FIG. 13, the number of output pulses of the needle position detector 13*a* are counted by the PC 65. When the number of output pulses of the needle position detector 13*a* are counted up, the sewing machine is stopped (step 202). Then, the PC 65 issues a command signal at the completion of sewing to the microcomputer 2 (step 304), so that the sewing operation is completed. The PC 65 issues a removing signal to the drive circuit 17*b* for removing the workpieces from the sewing machine (step 305). Therefore, the actuator 17*a* is driven, and the pieces of cloth 90, 91, which are joined together by sewing, are removed from the sewing machine. The PC 65 receives a removing completion signal from the sensor, and the generation of the removing signal is stopped.

The control code is advanced by one step (step 201), the control word "thread cutting" in the sewing data is read (step 200), and this signal is applied to the PC 65. The PC 65 issues a command signal of thread cutting to a thread cutting mechanism (not shown), so that the thread is cut. The microcomputer 2 reads a control word "completion" in the sewing data stored in RAM 53 (step 200), and the X-Y table 19 of the sewing machine is returned to the home position.

Concerning the above-described operations, if the sewing machine control unit 10 is provided with a function of counting the number of stitches, the software of the control unit 10 becomes complicated. Therefore, the function of counting the number of stitches is performed by the PC 65.

Accordingly, a problem arises in the conventional control apparatus for a sewing machine designed as described above in that it requires a PC 65 for implementing the control system of the sewing machine, and thus the sewing machine is complicated and its cost is relatively high. The reason is that the PC 65 issues a setting and removing signal for the workpiece to the drive circuit 17*b* of the actuator 17*a*, and further the PC 65 counts the number of output pulses of the needle position detector 13*a* so as to count the number of stitches of the workpiece.

A second problem is that the X-Y table cannot be operated at high speed. The reason is described as follows. When the X-Y table 19 is moved while the needle 13 pierces the workpiece, the workpiece is forcibly pulled, and hence the stitches become disordered. Sometimes the needle 13 can be broken. Accordingly, as shown in FIG. 16, pulse generation ranges applied to the pulse motors 19*a*, 19*b* are made different according to the distance from the tip of the needle 13 to the surface of the workpiece. In order to simplify the structure, the pulse generation ranges are set in accordance with the maximum thickness of the workpiece.

A third problem is that control of the speed of the pulse motors 19*a*, 19*b* cannot be appropriately conducted. The reason is described as follows. Vibration of the X-Y table 19 is changed into variation of the sewing motion of the sewing machine and of the sewing position of the X-Y table 19. Due to the foregoing, the speed of the pulse motors 19*a*, 19*b* used to drive the X-Y table 19 is made variable so that it can be appropriately restricted. In order to simplify the structure, the restriction value of the X-Y table 19 is also set.

In this connection, Japanese Unexamined Patent Publication No. 62-112587 discloses a technique in which the sewing area is divided into four portions, and a restriction speed of the sewing machine is set for each area. The area is composed of only four portions, and the restriction value of speed is set in each portion in such a manner that variations in stitching and the like do not occur even under worst-case conditions. Therefore, the problems are not essentially solved by this technique.

SUMMARY OF THE INVENTION

Accordingly, a first object of the present invention is to provide a control apparatus for a sewing machine characterized in that the microcomputer in the control unit of the sewing machine is provided with a sequence control function, and an on-signal for setting and removing a workpiece is incorporated into the sewing data, so that no PC exclusively used for sequence control is required. An object of the present invention is also to provide a control method for controlling the control apparatus for a sewing machine.

A second object of the present invention is to provide a control apparatus for a sewing machine characterized in that the X-Y table can be operated in accordance with the thickness of the workpiece, even when the sewing machine is conducting a sewing operation on a workpiece whose thickness is not uniform.

A third object of the present invention is to provide a control apparatus for a sewing machine characterized in that the sewing position or the sewing condition of a workpiece is judged by the sewing data, and the restriction value of the X-Y table is automatically changed so that vibration of the X-Y table can be suppressed to allow a high speed operation to be conducted.

In fulfillment of the above and other objects of the invention, in accordance with a first embodiment of the invention there is provided a control apparatus for a sewing machine comprising: an actuator for setting a workpiece on the sewing machine or removing it from the sewing machine; a drive means for driving the actuator on and off; a storage element for storing on-data in the sewing data by which a workpiece is automatically sewn, the on-data serving as an on-signal to set the workpiece on the sewing machine or to remove it from the sewing machine; detection means for generating a completion signal of the setting or removing of the workpiece; command means for generating an off-signal in the drive means in accordance with the detection of the completion signal by the detection means; start means for starting to set the workpiece on the sewing machine or to remove it from the sewing machine by operating the actuator when the drive means is turned on in accordance with the on-signal; and stop means for stopping motion of the actuator by turning off the drive means in accordance with the off-signal.

Further, in accordance with a second embodiment of the invention there is provided a control method for controlling a sewing machine comprising the steps of: storing sewing data for automatically sewing a workpiece in a storage element; storing on-data in the sewing data, the workpiece being set or removed in accordance with the on-data; operating an actuator by drive means in accordance with the on-signal so as to start setting the workpiece on the sewing machine or removing it from the sewing machine; detecting the completion of setting or removing of the workpiece after the generation of the on-signal so as to generate a signal to turn off the drive means; and stopping the actuator by turning off the drive means.

In accordance with a third embodiment of the invention there is provided a control apparatus for a sewing machine comprising: an X-Y table on which a workpiece is set, the X-Y table being driven by a motor so that the workpiece can be moved in X and Y directions; and a storage element for storing sewing data for automatically sewing the workpiece, the sewing data including setting data for setting means for setting the thickness of the workpiece at each point where the thickness of the workpiece changes, and motor movement data to be used by motor movement means for changing the range of movement of the motor in accordance with the thickness of the workpiece.

In accordance with a fourth embodiment of the invention there is provided a control apparatus for a sewing machine comprising: a vector detection means for reading sewing data and determining a directional vector for each stitch from the sewing data; a vector computation means for computing an amount of change in the directional vector for each stitch in accordance with a detection value obtained by the vector detection means; and speed restriction means for restricting the moving speed of an X-Y table in accordance with the amount of change in the directional vector computed by the vector computation means.

In accordance with a fifth embodiment of the invention there is provided a control apparatus for a sewing machine comprising: home position detection means for detecting a home position of an X-Y table; a needle movement amount detection means for detecting an amount of movement of a needle; a needle position computation means for computing a needle position on the X-Y table from a detection value detected by the needle movement amount detection means and also from the home position detected by the home position detection means; and speed restriction means for restricting the movement speed of the X-Y table in accordance with a computed value obtained by the needle position computation means.

BRIEF DESCRIPTION OF THE INVENTION

FIG. 2 shows a sewing data composition in accordance with the invention;

FIG. 6 is a parameter block diagram of the present invention;

FIG. 7 is a view showing a sewing data composition of the above embodiment;

FIG. 12 depicts the conventional sewing data;

DESCRIPTION OF THE PREFERRED EMBODIMENTS

Embodiment 1

Figure 1:
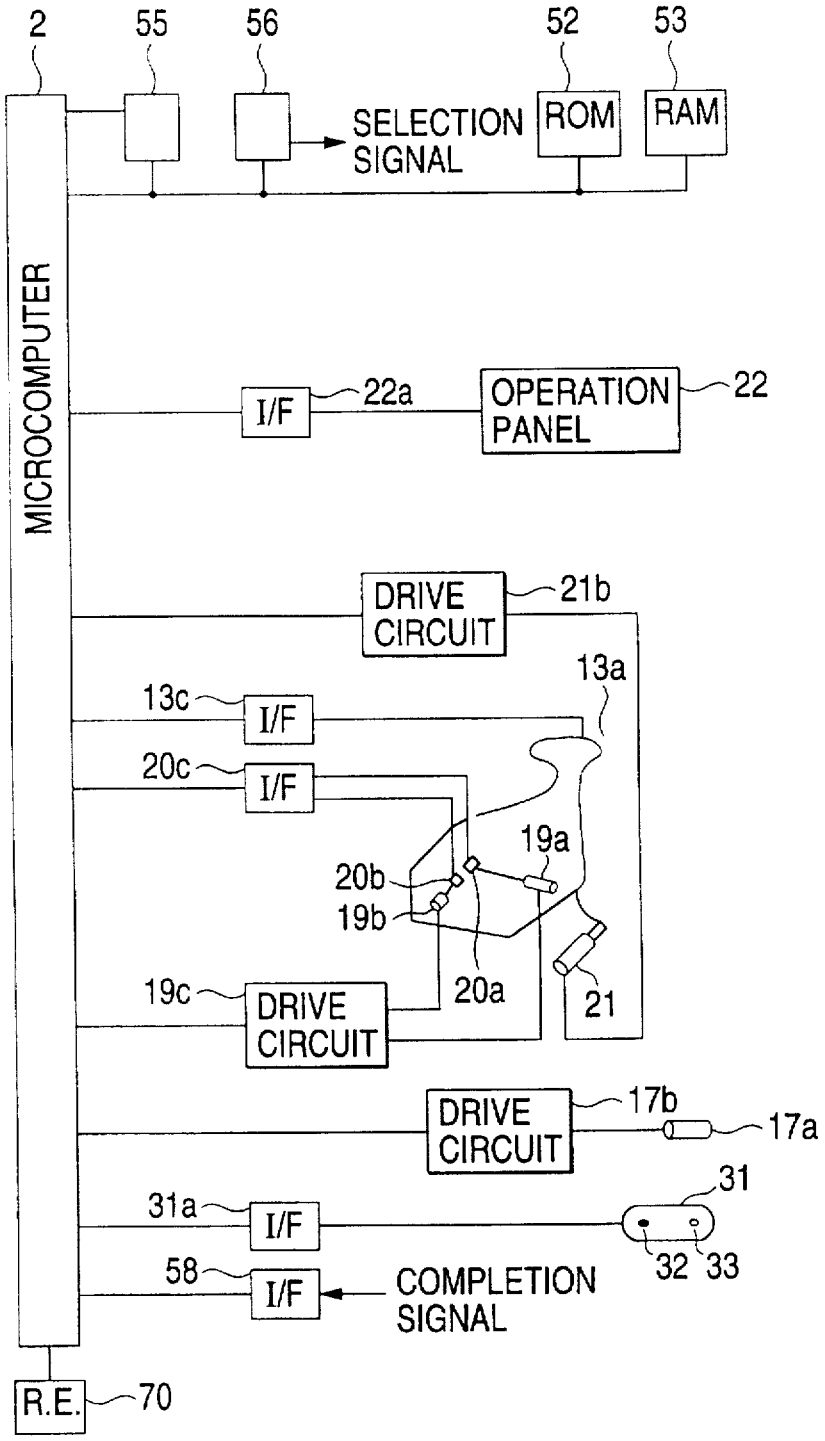
FIG. 1 is a diagram showing the arrangement of a control apparatus for a sewing machine constructed in accordance with a first preferred embodiment of the present invention.

FIG. 1 depicts the general arrangement of the control apparatus for a sewing machine constructed in accordance with a first embodiment of the invention. In FIG. 1, like reference characters are used to indicate like parts in the conventional apparatus. Reference numeral 58 is an I/F connected to the microcomputer 2. A completion signal for setting a workpiece on the sewing machine or a completion signal for removing a workpiece from the sewing machine is input to the I/F 58. Reference numeral 153 is a RAM (random-access memory). In this RAM 153, the sewing data shown in FIG. 2, which is used for automatically sewing a workpiece, is stored, and also the program of a module, which will be described later, is stored.

Figure 3:
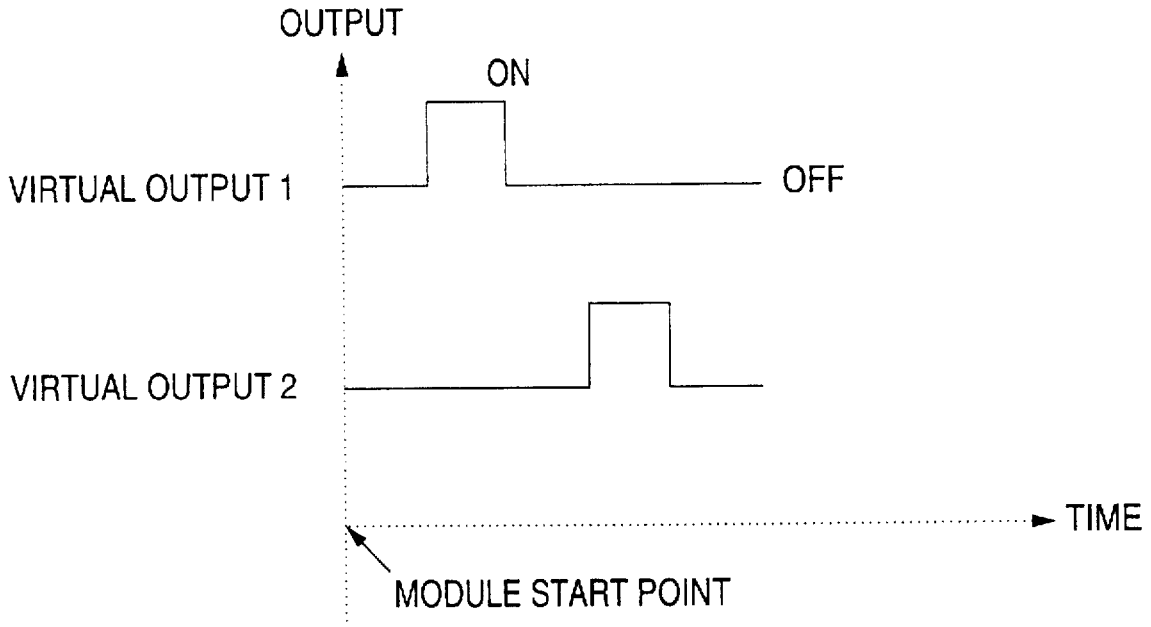
FIG. 3 is a timing chart of a sewing module.
Figure 4:
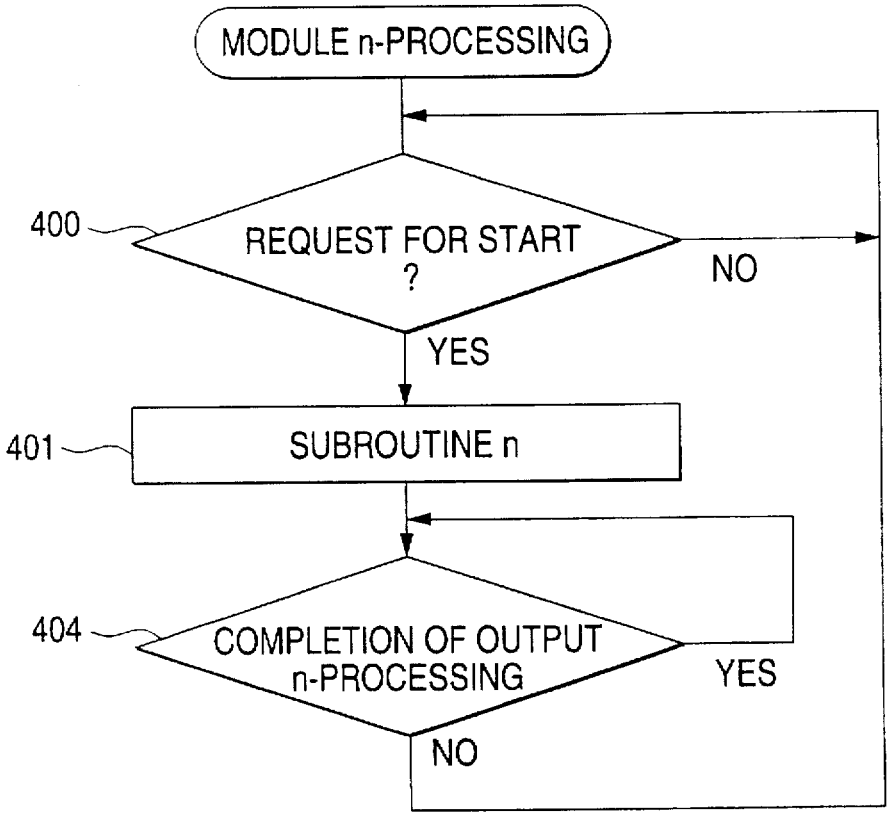
FIG. 4 is a flow chart for the module.

FIG. 3 is a timing chart for a module of sewing data. This module is turned on at the "start of the module" data in the sewing data and turned off by the setting of the workpiece in the sewing machine, or the removing of the workpiece from the sewing machine, or in response to the completion signal for cutting a thread. When the modules are combined with each other, sequence control can be carried out.

In this case, the on-off conditions of the modules 1 to 3 are set as follows. First, as shown in FIG. 2, the on-conditions of the modules 1 to 3 are turned on by the control mode "start of the module" in the sewing data and also by the reading of the argument. By this on-signal, a signal to set the cloth 90, 91 in the sewing machine or a signal to remove the cloth 90, 91 from the sewing machine is generated in the drive circuit.

After the generation of a signal to set the cloth 90 in the sewing machine, the off-condition of the module 1 is set in response to the completion signal. After the reception of the on-signal of the module 1, and after the generation of a signal to set the cloth 91 in the sewing machine, the off-condition of the module 2 is set in response to the completion signal. After the reception of the on-signal of the module 2, and after the generation of a signal to remove the pieces of cloth 90, 91 from the sewing machine, the off-condition of the module 3 is turned off by the completion signal. The off-conditions of the modules 1 to 3 described above are set.

Next, the operation start switch 32 is turned on, and it is checked whether or not an operation command is applied to the microcomputer 2 via I/F 22*a* (step 400). After the operation command has been applied to the microcomputer 2, the control word "start of module" in the sewing data stored in RAM 153 shown in FIG. 2 is read (step 200 in FIG. 14), and the argument is read. Since the argument is the module 1, the program is transferred to the subroutine 1 (step 401). In the subroutine 1 illustrated in FIG. 5, it is judged whether or not the output of the module 1 has been completed (step 500). Then, it is judged whether or not the output is turned on because this output has not been completed (step 501). Since the output is not turned on, the on-condition is checked (step 502). Since the on-condition is satisfied due to an operation command, the output is turned on (step 504). This on-signal is applied to the drive circuit 17*b*, and the cloth 90 is moved by the actuator 17*c* and set on the sewing machine.

The output of the module 1 is turned on, and the off-condition is checked by a signal which indicates whether the setting of the cloth 90 on the sewing machine has been completed (step 503). When this condition is satisfied, the output of the module 1 is turned off (step 505), and a flag indicating completion of sewing is set (step 506). Next, the step of the control word is advanced by one (step 201 in FIG. 14). Since the control word is "no-load feeding" in FIG. 12, the argument is read. As shown in FIG. 2, the cloth 90 is moved from the home position to the point "a" at the no-load feeding speed and by the amount of movement in the directions X and Y (referred to as a no-load feeding condition hereinafter).

Next, the step of the control word is advanced by one (step 201). Next, the microcomputer 2 reads the control word "sewing" in the sewing data stored in RAM 153 as illustrated in FIG. 2 (step 200). The argument is read, and the microcomputer counts the sewing stitches and the number of the output pulses of the needle position detector 13*a*, so that the cloth is sewn from the point "a" to the point "b" by three stitches, and then the sewing machine is stopped (step 202).

Next, the step of the control word is advanced by one (step 201). Since it is the start of the module and the argument is the module 2, the program is transferred to the subroutine 2 (step 401). It is judged whether or not the output of the module 2 has been completed (step 500). Since the output has not been completed, it is judged whether or not the output 2 is turned on (step 501). Since the output 2 is not turned on, the on-condition of the output 2 is checked (step 502). When the setting condition to set the cloth 91 is satisfied, the output 2 is turned on (step 504). The off-condition is checked by the setting completion signal of the cloth 91 (step 503). When this condition is satisfied, the output of the module 2 is turned off (step 505), and a flag of the completion of sewing is set up (step 506). By this on-signal, a signal by which the cloth 91 is set on the sewing machine is applied to the actuator 17*c* via the drive circuit 17*b*, so that the actuator 17*c* is operated and the cloth 91 is set on the X-Y table 19.

After the completion of the above motion, the next control word of "sewing" is read, and the argument is also read. Then, the cloth is sewn from the point "b" to the point "d" by 13 stitches in accordance with the sewing speed and the amount of movement in the X and Y directions, which will be referred to as a sewing condition hereinafter. The micro-computer counts the number of pulses of the needle position detector 13*a*. When it has counted up to the number of stitches, the sewing machine is stopped (step 202). The sewing completion command is applied to the control unit. Since the control word is "cutting of thread", the argument is read, and the thread is cut off at the point "d".

When the control word is "start of module", the argument is read. Since it is the module 3, the program is transferred to the subroutine 3 (step 401), and it is judged whether or not the output of the module 3 has been completed (step 500). Since the output is not completed, it is judged whether or not the output 3 is turned on (step 501). When the output 3 is not turned on, the on-condition of the output 3 is checked (step 502). When the removing signals for removing the pieces of cloth 90, 91 coincide with each other, the output is turned on (step 504). The setting condition is checked in response to the removing signals of the pieces of cloth 90, 91 (step 503). When this condition is satisfied, the output of the module 3 is turned off (step 505), and a flag of completion is set up (step 506). A signal to remove the pieces of cloth 90, 91, which have been sewn and integrated into one body by this on-signal, from the sewing machine is output. After the completion of sewing, the next control word of "end" is read, and the X-Y table 19 is moved and returned to the home position, and the home position is detected again, and a control operation to remove the pieces of cloth 90, 91 from the sewing machine is carried out.

As described above, the sewing data shown in FIG. 2 is carried out in order from the above. Even if the PC 65 is not provided, the sewing operation shown in FIG. 2 can be conducted by using the module, and even if the number of stitches is changed in the sewing operation, it is easy to count the changed number.

Figure 5:
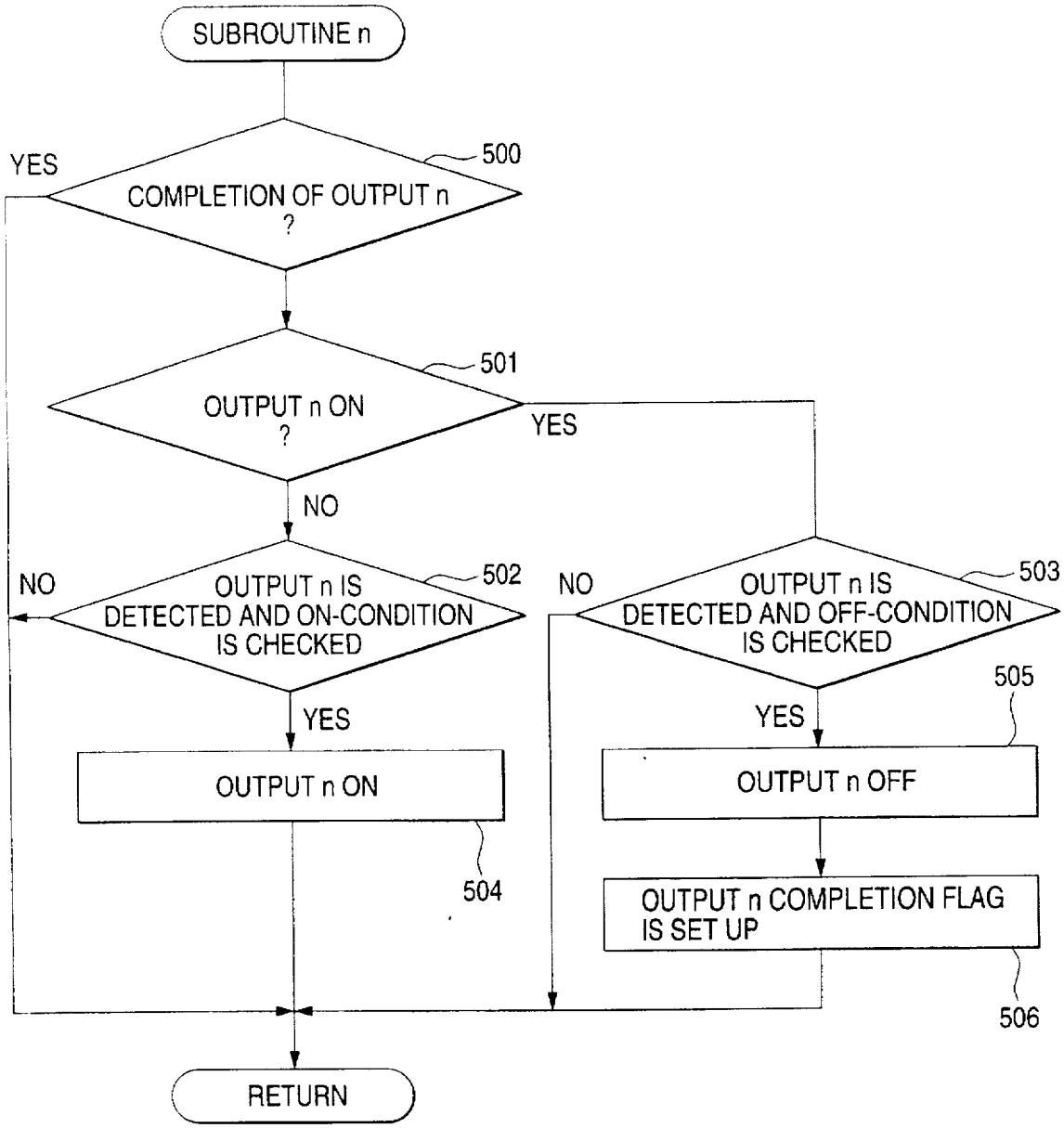
FIG. 5 is a view showing a subroutine in FIG. 4.

In this connection, in the above embodiment, steps 501, 503 in FIG. 5 are performed by a command means, steps 502, 503 represent the operation of start means, and step 505 represents operation of stop means. In the above embodiment, the start of the module is designated by the control code in the sewing data, however, the module may be operated by a signal of completion of cutting a thread, a signal of completion of sewing or a signal of returning to the home position irrespective of the sewing data. Start of the module is carried out by the control code in the sewing data, however, the module 2 or 3 may be started by satisfying a predetermined condition after the start of module 1. In this case, the predetermined condition is defined as "after the start of the module" or "after a predetermined period of time".

Embodiment 2

Another embodiment of the present invention will be explained below.

FIG. 6 is a view showing parameter blocks. In this case, the parameter is defined as a setting value for controlling the operation of the sewing machine. Examples of such parameters include the thickness of the workpiece, the changing ratio of the sewing size, the weight of the fabric presser, and the restriction of the torque of the motor. These parameter blocks are stored in RAM 153.

Figure 13:
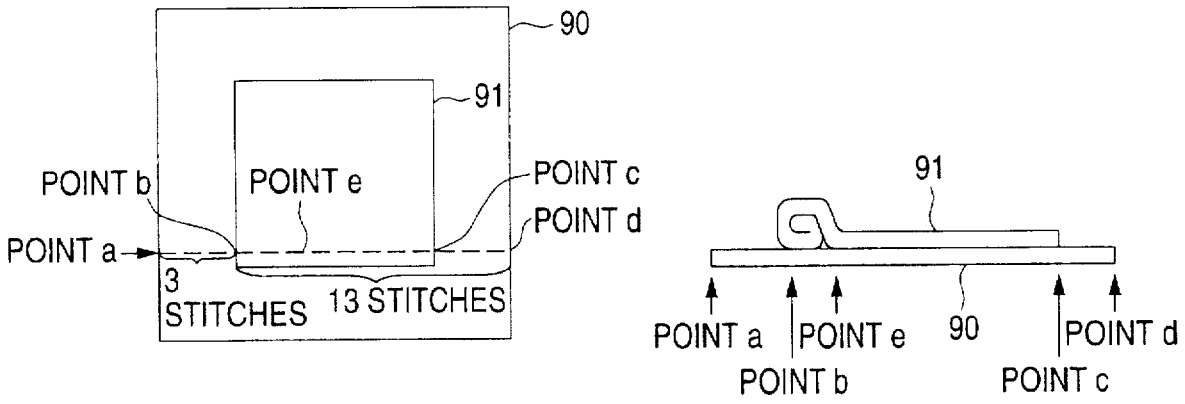
FIG. 13 shows a workpiece to be sewn.

When the thickness of a workpiece is not uniform as shown in FIG. 13, the thickness of the workpiece is set for each point (points "a", "b", "e" and "c") at which the thickness is different. In this way, the operational ranges of the pulse motors 19*a*, 19*b* used to drive the X-Y table 19 are changed by the drive circuit 19*c*, which is a motor operation means, so that the most appropriate control can be carried out. As shown in FIG. 7, the control code "change in the parameter" is inserted into the sewing data for each point at which the thickness of the workpiece is different. The parameter number "00000000" is set in argument 1, and the thickness of the fabric is set in arguments 2 and 3 (setting means).

Figure 14:
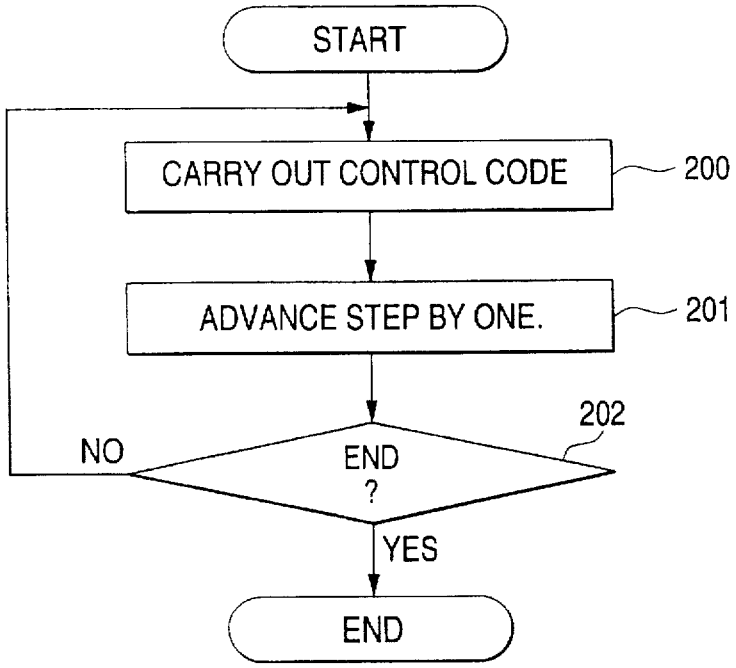
FIG. 14 is a flow chart showing operations in the conventional sewing machine.
Figure 15:
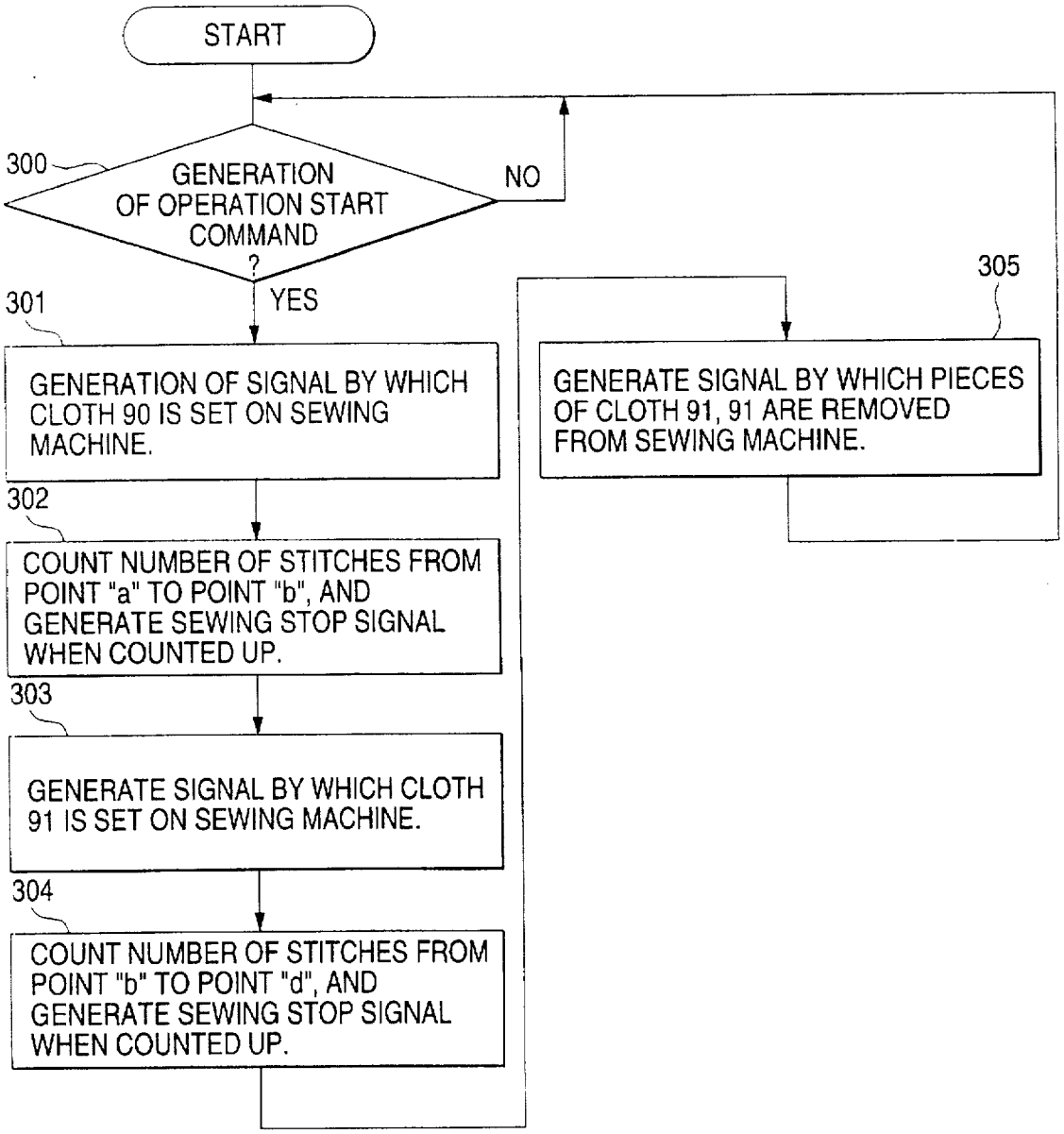
FIG. 15 is a flow chart showing operations in the conventional sewing machine.
Figure 16:
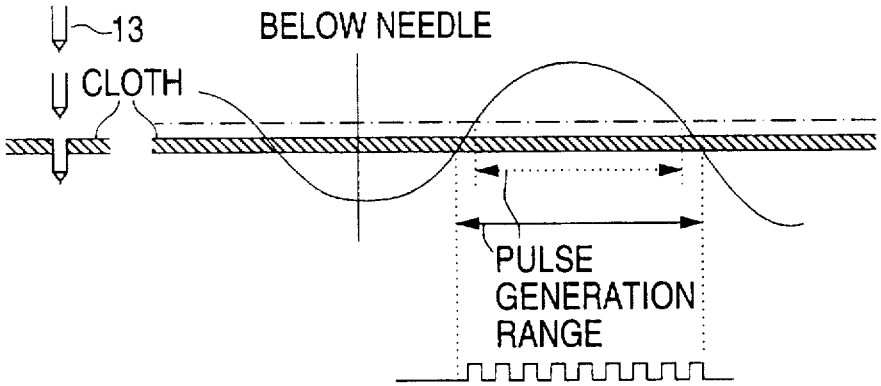
FIG. 16 is a view showing the relation between the pulse output range and the cloth thickness.

Referring to FIGS. 7, 13, and 14, the operation of this embodiment will be described below. Here, primarily the differences with respect to the first-described embodiment will be explained. First, the operation command is applied to the control unit. Then, operations in accordance with the sewing data shown in FIG. 7 are successively carried out.

The control word "change in the parameter" is read (step 200). The argument 1 is read. The thickness of the cloth at the point "a" is read. Next, the control word "sewing" is read (step 201). The argument is read. According to the sewing condition that has been read in this way, on the basis of the thickness of the cloth, the main shaft of the sewing machine is rotated in accordance with the distance from the tip of the needle 13 to the surface of the workpiece, and then the X-Y table 19 is operated, whereby the workpiece is sewn from the point "a" to the point "b" by three stitches.

After the sewing operation has been completed to the point "b", the next control word "change in the parameter" is read (step 201), and the argument is read. The thickness of the cloth at the point "b" is read. According to the sewing condition that has been read, on the basis of the thickness, an operation is conducted in the same manner as described above, and the workpiece is sewn from the point "b" to the point "e" by two stitches.

After the sewing operation has been completed to the point "e", the next control word "change in the parameter" is read (step 201), and the argument is read. The thickness of the cloth at the point "e" is read. According to the sewing condition that has been read, and on the basis of the thickness, an operation is conducted in the same manner as described above, and the workpiece is sewn from the point "e" to the point "c" by 11 stitches.

After the above operation has been completed, the next control word "sewing" is read (step 201), and the argument is read. The thickness of the cloth at the point "c" is read. According to the sewing condition that has been read, and on the basis of the thickness, an operation is conducted in the same manner as described above, and the workpiece is sewn from the point "c" to the point "d" by two stitches.

After the workpiece has been sewn to the point "d", the next control word "cutting a thread" is read (step 201), and the operation of cutting the thread is carried out. Then the next control word "end" is read (steps 201 and 202), whereupon the X-Y table 19 is operated to return to the home position.

Since the output range of the drive circuit 19*c* to drive the pulse motors 19*a*, 19*b* differs in accordance with the thickness of the workpiece, the thickness to be used as a parameter is set at each point where the thickness of the workpiece changes. Due to the setting of the thickness described above, it is possible to change the output range of the drive circuit 19*c* in accordance with the distance from the tip of the needle 13 to the surface of the workpiece. Accordingly, even if the thickness of the workpiece is not uniform, immediately after the needle 13 is drawn out from the workpiece, the X-Y table 19 can be operated.

In this connection, in the above embodiment, the thickness of the workpiece is set at each point where the thickness changes. However, other parameters such as the changing ratio of the size, the weight of the fabric presser or the amount of restriction of the motor torque may be set.

Embodiment 3

Figure 8:
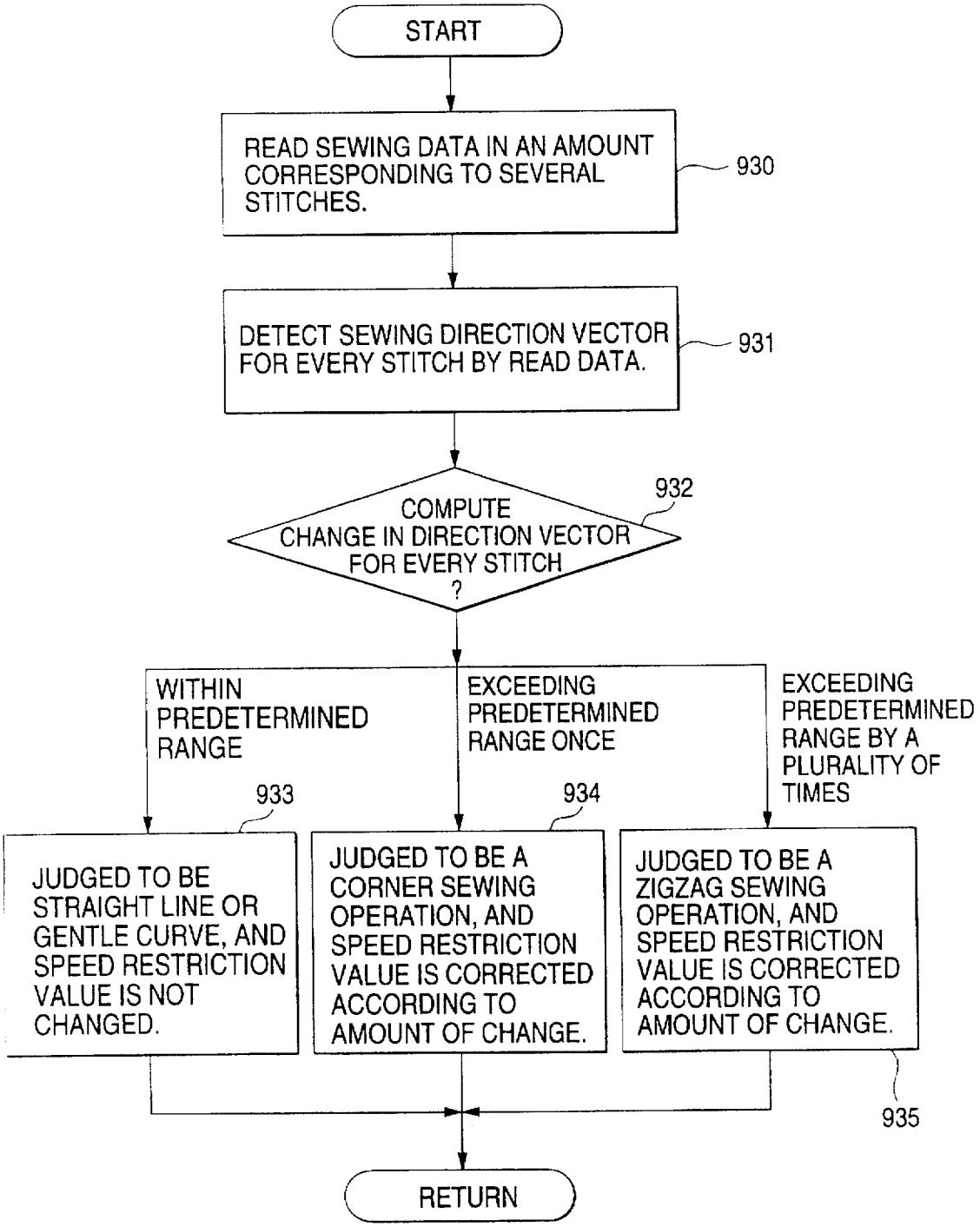
FIG. 8 is a flow chart for another embodiment of the invention.

Referring to FIG. 8, another embodiment of the present invention will be described below. Sewing data of several stitches is read from the sewing data for the workpiece (step 930). The vector in the sewing direction is detected for each stitch (step 931). The changing ratio of the directional vector for each stitch is computed (step 932). When a change in the vector for each stitch is within a predetermined range, it is judged to be a straight line or a gentle curve (step 933), and the speed restriction value of the X-Y table 19 is maintained at the reference value.

On the other hand, when the amount of change in the vector for each stitch exceeds a predetermined value (step 934), it is judged that the sewing operation is to be conducted at a corner of the workpiece, and the reference speed restriction value is multiplied by a predetermined value, so that the speed restriction value of the X-Y table 19 is lowered. When the amount of change in the vector for each stitch exceeds the predetermined value by a plurality of times (step 935), it is judged that the workpiece is subjected to zigzag-sewing, and the reference speed restriction value is multiplied by a predetermined value, so that the speed restriction value of the X-Y table 19 is greatly lowered. In this connection, the predetermined value to be multiplied with the reference speed restriction value is determined in such a manner that the predetermined value is proportional to a change in the sewing direction angle.

In this connection, in the above embodiment, step 930 in FIG. 8 represents operation of a vector detection means, step 931 represents operation of a vector computation means, and steps 934, 935 represent operation of speed restriction means.

Embodiment 4

Figure 9:
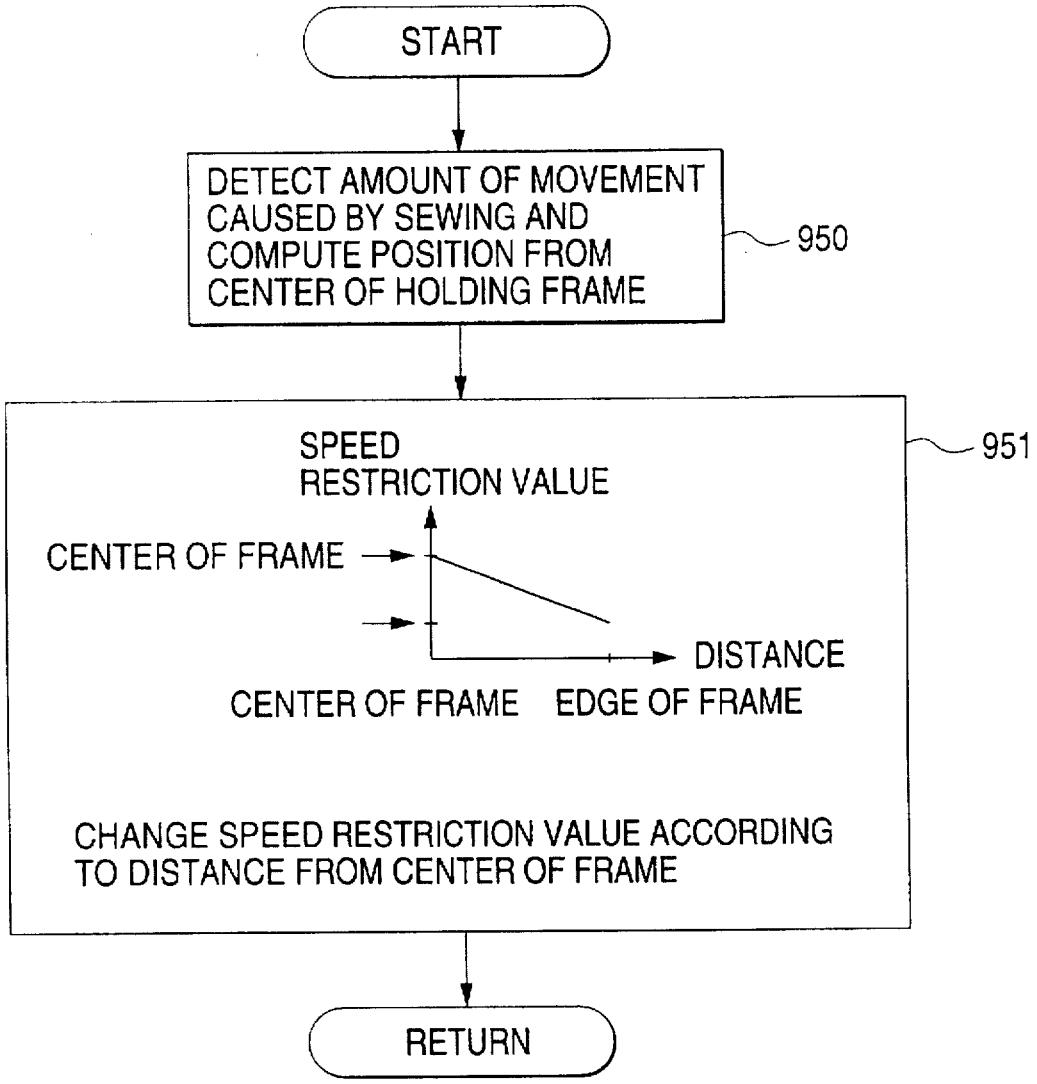
FIG. 9 is a flow chart for still another embodiment of the invention.
Figure 10:
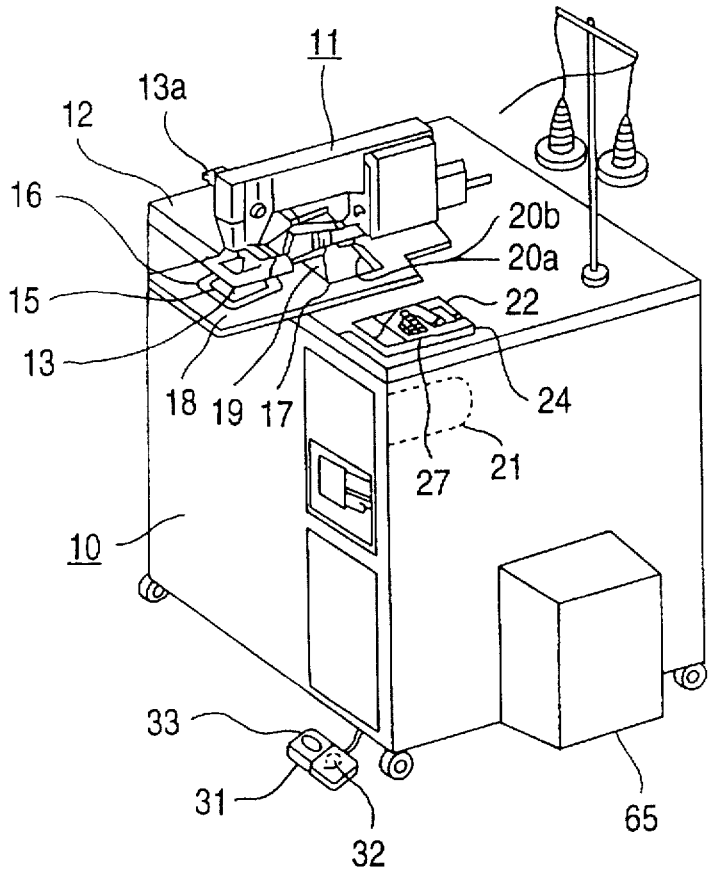
FIG. 10 PRIOR ART
FIG. 10 is a diagram showing a conventional sewing machine.
Figure 11:
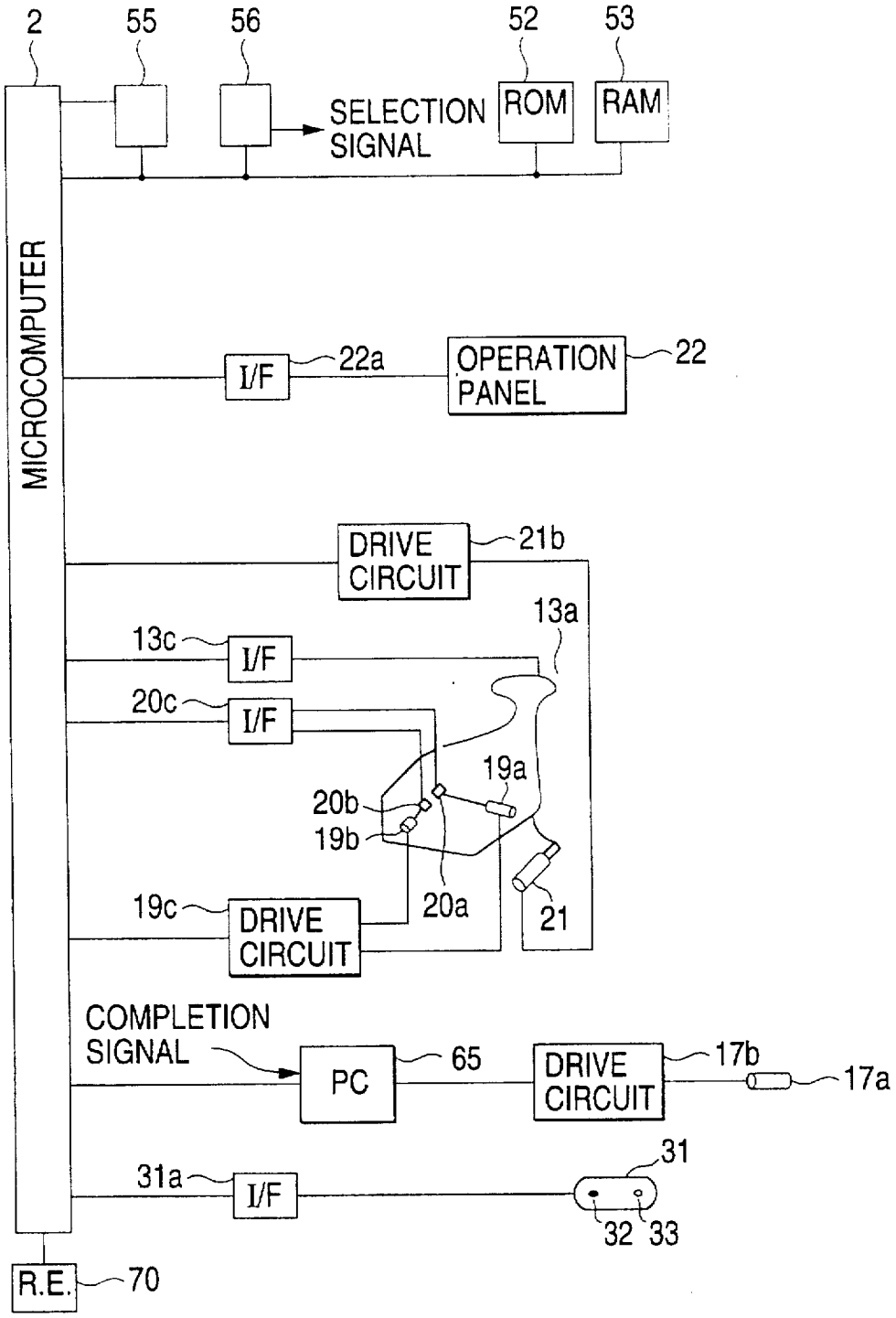
FIG. 11 PRIOR ART
FIG. 11 is a diagram showing the control apparatus of the conventional sewing machine.

Referring to FIG. 9, still another embodiment of the present invention will be described below. The amount of vibration generated differs according to the sewing position of the X-Y table 19. For example, when the center of the frame of the X-Y table 19 is sewn, the cloth absorbs vibration. However, when the edge of the frame of the X-Y table 19 is sewn, the sewing operation is susceptible to vibration. An example will be explained as follows, in which the vibration is suppressed and the maximum speed of the pulse motors 19*a*, 19*b* is restricted in accordance with the sewing pitch and other factors.

The home position, which is the center of the X-Y table, is used as a reference point. On the basis of this reference point, the amount of movement of the X-Y table 19 is integrated each time the sewing operation is started at this sewing start position (step 950). While the sewing operation is conducted at the center of the X-Y table 19, the speed of the pulse motors 19*a*, 19*b* is determined to be a speed restriction value corresponding to the center of the X-Y table 19 (step 951). While the sewing operation is conducted at a position close to the frame of the X-Y table 19, the speed restriction value of the pulse motors 19*a*, 19*b* is decreased. In this connection, the speed restriction value in the case of sewing an intermediate portion between the frame and the center of the X-Y table 19 is computed from the speed restriction values of the center and the frame, and is made proportional to the distance from the center to the intermediate portion.

In the above embodiment, step 950 in FIG. 9 represents a movement amount detection means and needle position computation means, and step 951 represents a speed restriction means.

According to the first and second embodiments, sewing data for automatically sewing a workpiece is provided with on-data which is used as the basis of an on-signal when the workpiece is set or removed, and an off-signal for setting or removing the workpiece can be generated while the sequence control operation is carried out. Accordingly, it is not necessary to provide a separate PC, so that the cost of the system can be reduced.

According to the third embodiment, the moving speed of the X-Y table is changed in accordance with the thickness of a workpiece. Therefore, it is possible to move the X-Y table at high speed without damaging the workpiece by the needle or breaking off the needle. Accordingly, the sewing time of the workpiece can be reduced.

According to the fourth embodiment, the control apparatus comprises vector detection means for reading the sewing data and detecting a sewing direction vector for each stitch from the sewing data, and a vector computation means for computing an amount of change in the directional vector for each stitch in accordance with the detection value detected by the vector detection means. Therefore, the moving speed of the X-Y table is restricted in accordance with the amount of change in the vector computation means. Accordingly, the workpiece can be sewn at the most appropriate moving speed of the X-Y table.

According to the fifth embodiment, the control apparatus comprises home position detection means for detecting the home position of an X-Y table, needle movement amount detection means for detecting the amount of movement of a needle, needle position computation means for computing the needle position on the X-Y table from the detection value obtained by the needle movement amount detection means and the home position detected by the home position detection means, and speed restriction means for restricting the moving speed of the X-Y table in accordance with a computed value obtained by the needle position computation means. Accordingly, the vibration of the X-Y table is reduced, and the apparatus can be operated at high speed.

What is claimed is:

1. A control apparatus for a sewing machine comprising:

an actuator for setting a workpiece on the sewing machine or removing the workpiece from the sewing machine;

drive means for driving the actuator on and off;

a storage element for storing sewing data for instructing automatic sewing of a workpiece, the sewing data including on-data for producing an on-signal to the actuator to set the workpiece on the sewing machine or remove the workpiece from the sewing machine;

detection means for detecting a completion signal relating to setting or removing of the workpiece;

command means for issuing an off-signal to the drive means in response to the completion signal produced by the detection means;

start means for starting to set the workpiece on the sewing machine or remove the workpiece from the sewing machine by operating the actuator when the drive means is turned on in accordance with the on-signal; and stop means for stopping motion of the actuator by turning off the drive means in accordance with the off-signal.

2. A control method for controlling a sewing machine comprising the steps of: storing sewing data for automatically sewing a workpiece in a storage element; storing on-data in the sewing data, the workpiece being set on or removed from the sewing machine in accordance with the on-data; operating an actuator by drive means in accordance with an on-signal produced in correspondence to said on-data so as to start setting the workpiece on the sewing machine or removing the workpiece from the sewing machine; detecting the completion of setting or removing the workpiece after the generation of the on-signal so as to generate a signal to turn off the drive means; and stopping the actuator by turning off the drive means.

3. A control apparatus for a sewing machine comprising:

an actuator for setting a workpiece on the sewing machine or removing the workpiece from the sewing machine;

a driver for driving the actuator on and off;

a memory for storing sewing data for instructing automatic sewing of a workpiece, the sewing data including modules of sewing data, each module of sewing data defining a predetermined sequence of sewing operations, said sewing data of each module beginning with on-data for producing an on-signal to initiate said predetermined sequence of sewing operations;

a detector for detecting a completion signal output when a module of sewing data has been performed;

command means for issuing an off-signal to the drive means in response to the completion signal produced by the detection means; and stop means for stopping motion of the actuator by turning off the drive means in accordance with the off-signal.

4. A control method for controlling a sewing machine comprising the steps of:

storing sewing data for automatically sewing a workpiece in a storage element, said sewing data comprising modules of sewing data, each module of sewing data defining a predetermined sequence of sewing operations, said sewing data of each module beginning with on-data for producing an on-signal to initiate said predetermined sequence of sewing operations;

operating an actuator by drive means in accordance with said sewing data;

detecting completion of each module; and issuing an off-signal to said drive means in response to the completion signal.

* * * * *